US006366742B1

(12) United States Patent
Reihl et al.

(10) Patent No.: US 6,366,742 B1
(45) Date of Patent: Apr. 2, 2002

(54) PRINTING OR COPYING SYSTEM WITH A REUSABLE CONTAINER FOR CONSUMABLE MATERIALS AND METHOD FOR USING SAID CONTAINER

(75) Inventors: Heiner Reihl, Freising; Edmund Creutzmann, Markt Schwaben; Wolfram Keil, Poing; Bernd Schoch, Markt Schwaben; Hans Winter, München, all of (DE)

(73) Assignee: Océ Printing Systems GmbH, Poing (DE)

( * ) Notice: Subject to any disclaimer, the term of this patent is extended or adjusted under 35 U.S.C. 154(b) by 0 days.

(21) Appl. No.: 09/485,331

(22) PCT Filed: Sep. 28, 1999

(86) PCT No.: PCT/EP99/07193

§ 371 Date: May 22, 2000

§ 102(e) Date: May 22, 2000

(87) PCT Pub. No.: WO00/19278

PCT Pub. Date: Apr. 6, 2000

(30) Foreign Application Priority Data

Sep. 28, 1998 (DE) ..... 198 44 435

(51) Int. Cl.[7] ..... G03G 15/00; G03G 21/16

(52) U.S. Cl. ..... 399/12; 399/109; 399/111

(58) Field of Search ..... 399/12, 13, 23, 399/24, 25, 27, 109, 111, 119, 120, 262; 347/108, 152, 138, 140

(56) References Cited

U.S. PATENT DOCUMENTS 4,961,088 A * 10/1990 Gilliland et al. ..... 399/25
5,049,898 A * 9/1991 Arthur et al.

(List continued on next page.)

FOREIGN PATENT DOCUMENTS

| | | |
|---|---|---|
| EP | 0 859 290 | 8/1998 |
| JP | 62-173482 | 7/1987 |

(List continued on next page.)

OTHER PUBLICATIONS

Japanese Patent Office—Publication 10161411 A—Jun. 19, 1998.

(List continued on next page.)

*Primary Examiner*—Sandra Brase
(74) *Attorney, Agent, or Firm*—Schiff Hardin & Waite

(57) ABSTRACT

In a method for improving the printing quality for electrographic color printing, print consumables, particularly toner, are monitored in container-exact fashion and substance-specific information are employed for the control of the printing process. Toner expiration dates for the consumables are identified and noted early at the respective printing location. The consumable contained in the container and the amount of consumable contained is thus stored in machine-readable fashion at the container. An information carrier is provided at the container for non-contacting transmission of data and energy from a data read and/or write station to the container. A transponder that is provided with an individual hardware identifier is provided as the information carrier. The hardware identifier may be employed as a component part of codes for device control. The printer or copier system disclosed includes a recycling concept for consumables containers. One and the same container is multiply employed, and the current container content can be acquired container-individually at any time by machine. The containers are provided with the information carrier that contains the machine-readably encoded information about the current or more recently contained consumable situated in the container. A module that can be electronically written and read in non-contacting fashion is employed as the information carrier, particularly the transponder. The data stored in the transponder can be supplied to other system components such as a filling station, a central computer with a data bank, and the printer or copier devices.

10 Claims, 8 Drawing Sheets

U.S. PATENT DOCUMENTS

| | | | | | |
|---|---|---|---|---|---|
| 5,132,729 | A | * | 7/1992 | Matsushita et al. | 399/24 |
| 5,208,631 | A | | 5/1993 | Jacobs et al. | |
| 5,235,384 | A | * | 8/1993 | Oka et al. | 399/27 |
| 5,289,242 | A | * | 2/1994 | Christensen et al. | 399/12 |
| 5,512,988 | A | * | 4/1996 | Donaldson | 399/120 |
| 5,596,388 | A | | 1/1997 | Ohkubo et al. | |
| 5,699,091 | A | * | 12/1997 | Bullock et al. | 399/24 X |
| 5,930,553 | A | * | 7/1999 | Hirst et al. | 399/12 X |
| 5,974,500 | A | * | 10/1999 | Maletsky et al. | |
| 6,053,597 | A | * | 4/2000 | Hirota | 399/12 X |
| 6,227,643 | B1 | * | 5/2001 | Purcell et al. | |

FOREIGN PATENT DOCUMENTS

| | | |
|---|---|---|
| JP | 63-212956 | 9/1988 |
| JP | 3-230172 | 10/1991 |
| JP | 07-121016 | 5/1995 |
| JP | 7-234578 | 9/1995 |
| JP | 10-161411 | 6/1998 |
| JP | 10- 221938 | 8/1998 |

OTHER PUBLICATIONS

Patent Abstracts of Japan—Publication 10221938 A—Aug. 21, 1998.

Patent Abstracts of Japan—P–860 Apr. 20, 1989 vol. 13/No. 165; Publication 1–3683.

Patent Abstracts of Japan—P–1562, Jun. 23, 1993 vol. 17, No. 332—Image Forming Device; Publication 5–40371.

Patent Abstracts of Japan—Publication 10198146 A—Jul. 31, 1998.

Patent Abstracts of Japan—P–1520 Apr. 12, 1993 vol. 17, No. 187; Publication 4–338990.

Patent Abstracts of Japan—Publication 09120238 A—May 6, 1997.

* cited by examiner

PRINTING OR COPYING SYSTEM WITH A REUSABLE CONTAINER FOR CONSUMABLE MATERIALS AND METHOD FOR USING SAID CONTAINER

BACKGROUND OF THE INVENTION

The invention is directed to a printer or copier system as well as to a method for filling a container with consumables, a method for multiple employment of such a container in at least one printer or copier device, a well as to a method for encoding the container. The invention is particularly directed to a method for the operation of an electrographic printer or copier device as well as to such a printer or copier device. The invention is also directed to a printer or copier system that comprises an electrographic printer or copier device as well as a filling station for filling, as well as a filling station for filling containers with electrographic consumables.

WO-A-96/02872 (PCT/DE 95/00635) discloses an electrophotographic means for both-sided printing of a band-shaped, narrow recording medium and for single-sided printing of one broad recording medium or a plurality of parallel, narrow recording media.

High-performance printers of this type are often employed for printing out data in computer centers. These data can, for example, be invoices or other individualized printouts, for example individualized advertising. There is thereby the more and more frequent demand to print printing jobs in multi-colored fashion. With modularly constructed printers, it is therefore possible to keep a plurality of developer stations suitable for chromatic printing operation available, these being respectively provided for printing out in different colors. DE 195 40 138 C1, for example, discloses a developer station that can be inserted into the corresponding printer as needed given the existence of a multi-colored printing job and can be interchanged with the one-color developer station. A uniform, performance-matched traffic load of printer parks in printer centers thus derives.

When individual components such as developer stations are to be changed given the existence of different printing jobs, then this procedure must be monitored in order to assure a uniformly good print quality as well as allocation errors between the color required in the printing job and the color that is actually developed.

Added thereto is that different types of toner are being increasingly utilized in electrographic printers. Even given single-color printing jobs, different types of toner are utilized for different applications. Since these types of toner generally have different physical properties, the printing machine must be driven with different process parameters in order to keep the printing quality at a high level. For this purpose, it is necessary that the control of the printer automatically recognizes what type of toner is currently in the apparatus.

When print jobs are printed in different colors, then the additional demand arises that different-colored toner that must be stored in reservoirs of the printer must be allocated to the correct toner conveying systems for the respectively correct developer stations.

U.S. Pat. No. 4,994,853 discloses an electrophotographic printer having a plurality of chromatic developer stations, whereby IC cards are attached to the developer stations wherein process-relevant information for the printer control are made available. U.S. Pat. No. 5,596,388 and JP-A-4-338990 disclose process cartridges for toner on which toner-related information are applied with bar code stickers. JP-A-1-3683 discloses a toner container to which a magnetic strip is applied. Particulars about the toner contained in the container are stored on the magnetic strip.

JP-A-10-161411 discloses that a semiconductor memory element on which information about the toner contained in the container are stored be attached to a toner container. The toner data can thereby be transmitted in non-contacting fashion. JP-A-10-221938 discloses a corresponding toner container wherein data can be transmitted in non-contacting fashion into a data memory with antennas.

Given printers or, pre-devices that are based on different recording principles, for example given ink jet printers, it is also definitely necessary that device parameters be set dependent on the consumables, for example the temperature of the ink given bubble jet printers or the voltage of deflection electrodes given printers that work with a continuous ink flow according to the Paillard principle.

Corresponding to the high printing performance, the toner consumption in electrographic high-performance printing units is also high. The toner is thereby stored in containers that are introduced into the electrophotographic printer or copier devices. When a developer station is replaced, then the toner matching the new developer station must also be delivered within the copier device.

SUMMARY OF THE INVENTION

An object of a first aspect of the invention is to assure the correct delivery of consumables in printer and copier devices in order to be able to process consumables of different types in the devices.

According to the present invention, a method is provided for encoding a container for receiving consumables of electrographic printer or copier devices wherein consumable-specific data are applied in encoded fashion in machine-readable form on the container with an information carrier. Preferably the information carrier comprises an electronic circuit, preferably a transponder, that can be read and written in non-contacting fashion. A read station may be provided with which data and energy can be exchanged with the transponder in non-contacting fashion for writing and/or reading the information stored on the transponder. A system is also provided for practicing the method in a printer or copier device.

Inventively, a container that is capable of accepting consumables, particularly toner for electrographic printer or copier devices, is provided with machine-readable information with a suitable information carrier or, respectively, is encoded in machine-readable form. In particular, the information comprise data about the nature of the consumables located in the container such as, for example, toner recipes for printers or copier devices that work according to the electrographic principle. What is thereby particularly understood is electrophotography but, for example, magnetography and other electrostatic recording methods as well.

The inventive solution also creates a recycling concept with which containers for consumables of printer or copier devices can be multiply employed, namely both in one and the same printer or copier device as well as in different devices. In particular, the devices are of an electrographic type. What is achieved in conformity with this second aspect of the invention is that not only can fresh consumables such as toner be stored in the container but, for example, used mixtures such as toner-developer mixtures, that are composed of toner and magnetizable carrier particles can also be stored therein. The consumables can be solid, powdered or liquid.

The transport of the consumable, particularly of the substance, is completely monitored in a closed system as a result of the invention, and the transport of the substance can be tracked from delivery up to printing within the printer or copier device, and the information attached to the container can be electronically machine-read and be employed for controlling parameters of the printing process.

As a result of applying machine-readably encoded, particularly binary information about the consumables currently or most recently located in the container, the necessity of having to input this information by operating personnel of the printer or, respectively, copier is eliminated. Further, one and the same container can be employed for the plurality of purposes as a result thereof, particularly for storing fresh toner but also for waste disposable of unuseable developer mixtures or toner residues.

The invention enables an automatic circulation system, whereby the containers for printing consumables can be fully automatically processed at various stations such as a filling station in the printer or in a cleaning station as well. Additionally, a computer network with a central data bank can be provided in the circulation system, this being described later.

As a result of the machine-readably encoded information about a consumable currently located in the container, in particular, it is possible to assure the proper allocation between supply container as well as connected conveying system for the consumable in a printer or copier device and devices such as a developer station at an electrographic printing station connected thereto. In an advantageous exemplary embodiment for electrographic printer or copier devices, it is provided for this purpose to mechanically rigidly connect the toner conveying channel in a toner conveying system to an electrical encoding line such that an electrical connection between an electrical circuit situated in the container and the developer station is produced when the mechanical connection between toner supply container and allocated developer station that is necessary for toner transport is produced, whereby the information stored in the container about the container is compared in view of suitability for the developer station.

In a further, advantageous exemplary embodiment, a measuring instrument is provided with which the amount of consumables stored in the container can be acquired. By storing the amount of contents in the electronic information store, it can be assured that a supply container that has once been taken is not inadvertently filled with additional, unsuitable consumables, and a malfunction is thus avoided when the container is re-introduced into the same or into a different printer. It is thereby especially advantageous when the quantity value is stored in the information store as soon as the container is removed from the printer or copier device.

Optically visible bar code carriers that display static information—for example for the type of consumable—or that can both be written as well as erased—for example, for simple updating of the quantity of consumable contained in the container—are suitable as information carrier rigidly connected to the container. Further, electrically encodable labels or electrically readable and writable carriers such as magnetic strips, optical data carriers (DVD, re-writable CD-ROMs, Laser-Cards) or EEPROMs (electrical erasable programmable read only memories) and, in particular, transponders are also suitable for this purpose. The data transmission preferably ensues a non-contacting fashion between the information store and a read and/or write station.

In a preferred exemplary embodiment, a transponder is employed as information carrier. Such electronic components usually carry a permanently allocated, individual coding. For example, they are determined as hardware identifier in an area reserved by the transponder manufacturer. The hardware identifier is, in particular, deposited in a PROM region (programmable read only region) of a semiconductor memory. The PROM region can only be written once, particularly by the manufacturer of the transponder, and can only be read but no longer written later. A plurality of PROM regions can also be provided in the transponder, whereof at least one region can only be written once by a user of the transponder, particularly during the course of an initial filling of the toner container with toner, and can then only be read later. By contrast thereto, data can be dynamically stored, erased and/or overwritten in an EEPROM area of the transponder. The data transmission from and to the transponder can ensue a non-contacting fashion with radio frequency transmission. A write/read means is provided for this purpose, this enabling both a data exchange with the transponder as well as supplying energy for supplying the electronic component parts contained in the transponder to the transponder in non-contacting fashion.

In a highly simplified exemplary embodiment of the transponder, a transponder that can be written only once and that can then only be read later can also be employed for some aspects of the invention. Such a transponder comprises only one PROM region and is somewhat more beneficial than a re-writeable transponder in view of the manufacturing costs. It is particularly suitable for the one-time storing of toner data on a toner container filled with tone only once.

By comparing the information deposited on the information carrier to operating information that are stored in the printer or copier device, the possibility then derives of outputting alarm messages at the appertaining device when containers having unsuitable consumables are utilized. When, for example, toner whose manufacturing date has already been exceeded or toner of a color different from that required by the developer station currently inserted in the printer is introduced, then the printing operations can be additionally prevented in order to avoid misprints (Maculature).

According to a further aspect of the invention, a data bank is provided outside the container for electrophotographic consumables wherein the data stored in the container are additionally deposited. In particular, the data bank can contain the current data from a plurality of containers, so that the current values of a great number of containers are always available. To that end, it is particularly advantageous to network the read/write stations of the various, participating container processing stations that process the containers with one another. The advantageous possibility of centrally outputting alarm messages to the printer from the data bank when containers having unsuitable consumables, for example having toner whose manufacturing date has already been exceeded, are inserted then particularly derives for the printer or copier devices that are thereby connected. There is also the possibility of already drawing the attention of computer centers thereto at an early time when, for example, supply containers for consumables that have been acquired and stored for a longer time have reached an end stage or, respectively, their expiration date. Further, there is thus the possibility of individually allocating specific supply containers to a specific printer, a computer center or an operator and of accordingly logistically administering the container pool.

A determination can be made when refilling toner supply containers as to whether the toner gray provided for the filling is chemically and/or optically compatible with the types of toner (or with the various types of toner) previously situated in the toner supply container. Only toner whose hue is darker then the hue (or, respectively, then the hues) of earlier fills is allowed given a refilling, so that a high print quality is assured even when old toner residues were not capable of being completely removed from the toner container during cleaning.

Further effects and advantages of the invention are described below with reference to some exemplary embodiments:

DESCRIPTION OF THE PREFERRED EMBODIMENTS

Figure 1:
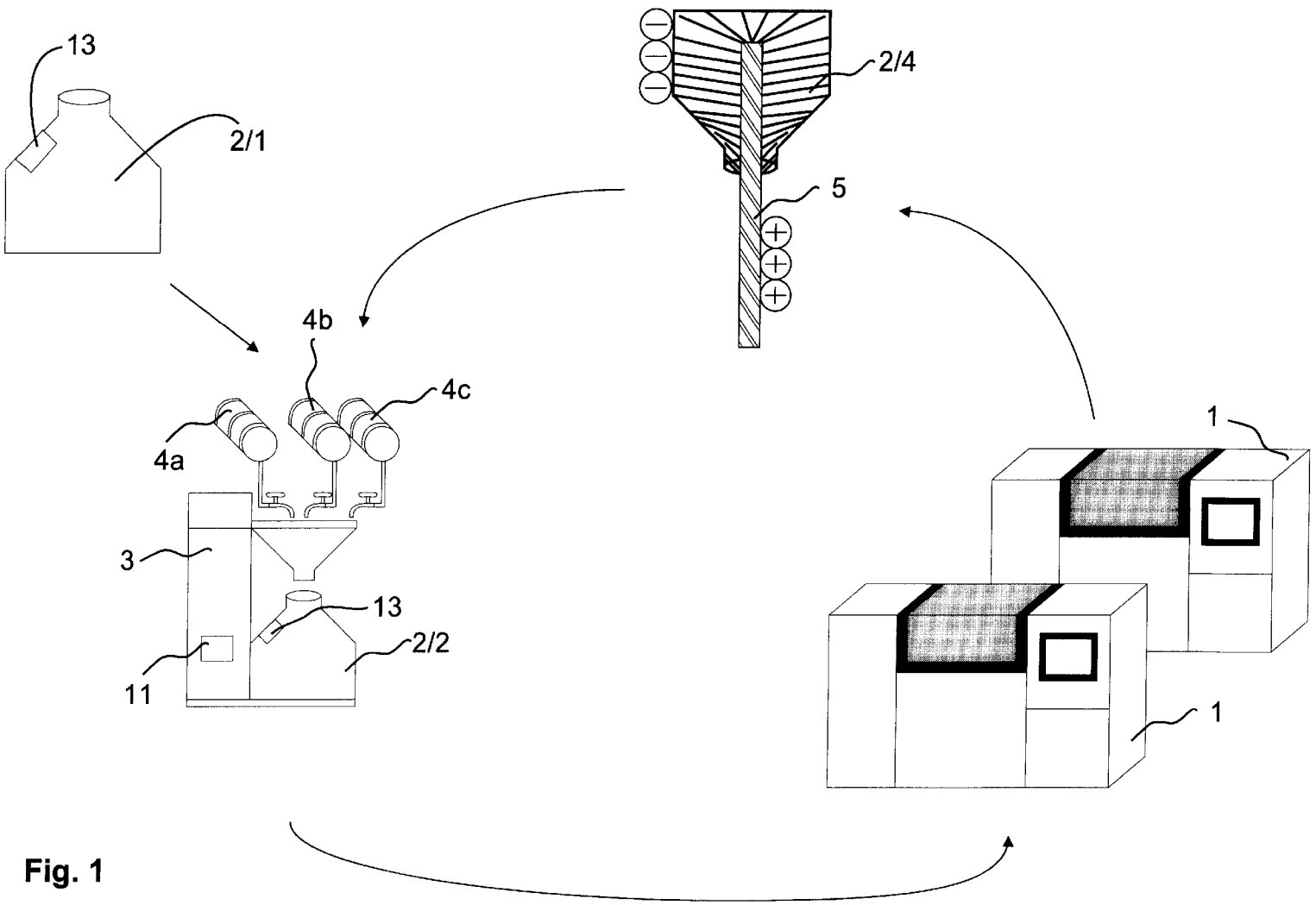
FIG. 1 shows a recycling method for toner containers.

FIG. 1 shows a container 2 that is equipped with a data store, what is referred to as a transponder 13, that can be electronically written and read out in non-contacting fashion. The container 2 is supplied (positioned 2/2) to a filling station 3 during the course of a new manufacturing process (position 2/1). The transponder 13 is occupied with a hardware identifier at the manufacturer's side, this lying in a reserve memory area. The hardware identifier 13 is burned into a non-deletable PROM (programmable read-only memory) of the transponder 13 and is thus suitable for the unambiguous identification of the transponder 13. Similar to electronic lock systems, the identification can be employed for encoding (locking) and decoding (unlocking) (lock) information.

In position 2/2 within the filling station 3, the container 2 is filled with toner from one or more toner storage tanks 4*a*, 4*b*, 4*c* according to a predetermined recipe. The toner can thereby be processed as solid (powder) or dissolved as liquid.

Filling data such as recipe identification number, the filling date, the weight, etc., can be written and coded, and, optionally, additionally encrypted into an EEPROM (electrically erasable programmable read-only memory) of the transponder 13 in machine-readable form with a read/write station 11. The writing of the transponder 13 occurs with electromagnetic radiation (radio frequency), occurring in non-contacting fashion. As a result of the filling or, respectively, of the transmission of the machine-readable data into the transponder 13 of the container, the container can now be identified as a specific, individual toner supply container.

All data or specific data groups on the transponder can be deposited by the read/write station 11 password-protected or encrypted, too, in a crypto-mode.

In these cases, the corresponding data or, respectively, data groups can be read out again only by providing the password and/or a decryption code.

Various operating modes in the communication with the transponder 13 can be provided in the read/write station 11. In a first operating mode (crypto mode), data are only transmitted encrypted. In a second operating mode (password mode), data can be read from the transponder and/or written onto the transponder only when a password is provided. For reading, a password stored on the transponder is compared in the transponder 13 to a password to be input via read/write station 11. The transponder 13 releases the data stored on it for transmission only given identity of the two passwords. For writing, a password is deposited on the transponder or a password already stored on the transponder is reemployed. In a third mode (first public mode), data can only be read from the transponder 13 but not written onto it. In a fourth mode (second public mode), data can be freely read from the transponder 13 as well as written onto the transponder 13.

The transponder 13 is firmly embedded into the container 2 during the course of the manufacturing process (2/1). When the container 2 is composed of plastic, then the transponder 13 can be fused into the plastic. However, a holder provided at the container 2 can also be utilized, glued on or firmly joined to the container 2 in some other way.

The transponder 13 can be viewed as a passive electronic component having a permanently and unambiguously allocated, individual coding. The energy supply of the transponder occurs from the read/write station 11, likewise via radio channels that are transmitted from an antenna of the read/write station 11 and are received by an antenna integrated in the transponder 13. During the course of the communication between read/write station 11 and transponder 13, the read/write station identifies the presence of the transponder 13 as well as its individual coding number (identifier).

After the filling of the container 2 in the filling station 2 (position 2/2), the container 2 is inserted into a printer 1. In high-performance printers such as the Océ-Pagestream® series, whose printing performance amounts to up to 500 DIN A-4 pages per minute, a 3 kg toner container 2 is emptied in about 30 minutes. In order to assure a constant monitoring and a timely replacement of the toner supply container 2 and in order to enable a timely display on the control panel of the printer 1, the quantity of toner taken during printing is continuously acquired in the printer, for example by measuring the weight of the toner supply container or with a sensor that measures the toner filling level in the toner supply container. Such a sensor can, for example, be based on a capacitative measuring principle.

After printing, the toner supply container 2 is removed from the printer and cleaned in a cleaning station. Powdery toner residues are thereby emptied by shaking the toner supply container 2; as needed, it can be additionally cleaned with cleaning brushes or can also be rinsed out with a cleaning fluid. For better separation of the toner particles from the container walls, the container and the cleaning tools are respectively charged oppositely relative to one another during the cleaning procedure (for example, bottle positive, tools negative).

The supply container 2 can accept both toner as well as a mixture of toner and ferromagnetic material (developer).

Figure 2:
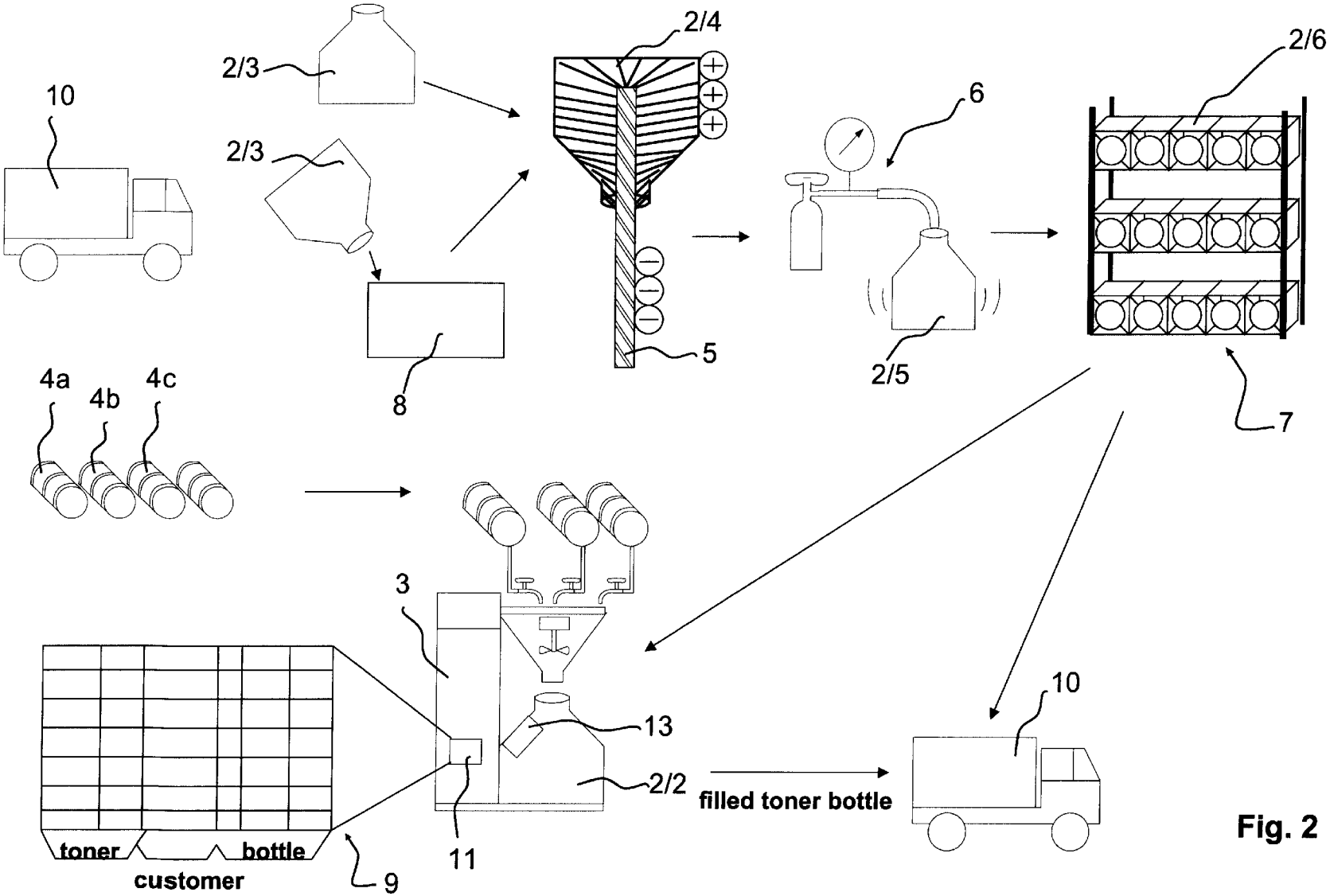
FIG. 2 shows an expanded recycling method wherein containers for developer mixes are also provided.

The cleaning procedure for supply containers as well as the filling procedure for toner supply containers is explained in greater detail in FIG. 2. The containers 2 are delivered with a transport vehicle 10 and are pre-selected in a position 2/2 with the data of the transponder 13. Completely emptied toner supply containers are directly supplied to the cleaning station 5 (position 2/4). Partially emptied toner containers or containers 3 wherein used toner/developer mixtures are contained are emptied into a waste disposal container 8 and are then supplied to the cleaning station 5.

After cleaning, the containers 2—in a position 2/5—pass through a testing station 6 at which they are checked for mechanical damage as well as for leaks. The leak test occurs with a compressed air unit. Subsequently, the cleaned and tested containers 2 are intermediately stored in a warehouse 7 (2/6). Containers that are to be filled with toner are supplied directly to the filling station 3; containers that are to be re-employed as waste disposal containers are supplied directly to the transport vehicle 10 that outputs the containers in the direction to the printing center. For distinguishing between toner supply containers and waste disposal containers, these are correspondingly identified as toner or waste supply containers in the transponder.

The sum of those data that are transmitted via the write station 11 into the transponder 13 are simultaneously entered into a data bank 9 within the filling station 3, this including at least the identification number of the toner bottle as well as the type of toner (recipe). In addition, data about the customers to be supplied as well as the filling date or the like can be deposited. The data bank is stored in a central logistics computer that is connected via a computer network to the filling station 3 and/or to the printers connected at the customer. Table 1 shows possibilities of such data as well as the inter-relationships between the participating process units (printer, filling station, container).

During the course of the filling event, the identification data stored in the PROM area of the transponder 13 and/or the encoded key data are read out and potentially checked for correctness on the basis of earlier data contained in the data bank 9. The variable data stored in the EEPROM area of the transponder are also checked and updated.

During filling, the amount of toner actually filled into the toner is monitored on the basis of a suitable measuring system (weight sensor, capacitative filling level sensor). After the end of the filling procedure, the necessary, variable data such as type of toner and toner fill quantity are transmitted into the variable memory areas of the transponder 13 as well as into the data bank 9.

Whether the same toner type that was already contained in the container before the cleaning is in turn refilled can, for example, be acquired with the filling station and the exchange connected therewith. Further, a check can be carried out as to whether another toner type to be filled is chemically and/or optically compatible with the one toner type previously located in the toner supply container or, when a container history is stored, is chemically and/or optically compatible with the various toner types previously situated in the toner supply container. When only toner whose hue is darker than the hue (or, respectively, the hues) of earlier fills is allowed for filling in a refilling, then a high printing quality is assured even when old toner residues were not capable of being completely removed from the toner container during cleaning. For this purpose, corresponding tables of compatible, successor toner fillings are maintained in the filling station and the information read from the container is employed for controlling the filling process.

The data maintained in the data bank 9 can be employed for logistic purposes such as, for example for administration of the containers in circulation, for monitoring toner expiration dates, etc.

Toners of different colors mixed according to predetermined recipes can be filled into the supply container in the filling station 11 or into intermediate containers as well that are in turn used later for filling toner supply containers in circulation that are equipped with transponders 13. Instead of the read/write station for the transmission of electronic data from and into a transponder that is arranged in the filling station and has been described, some other coding station, for example a label gluing station for conductive/non-conductively encoded labels or a magnetic coding station can be provided for processing correspondingly equipped supply containers. The data transmission from and to the transponder or, respectively, container can occur during the course of filling before, during or after the filling procedure as well.

Figure 3:
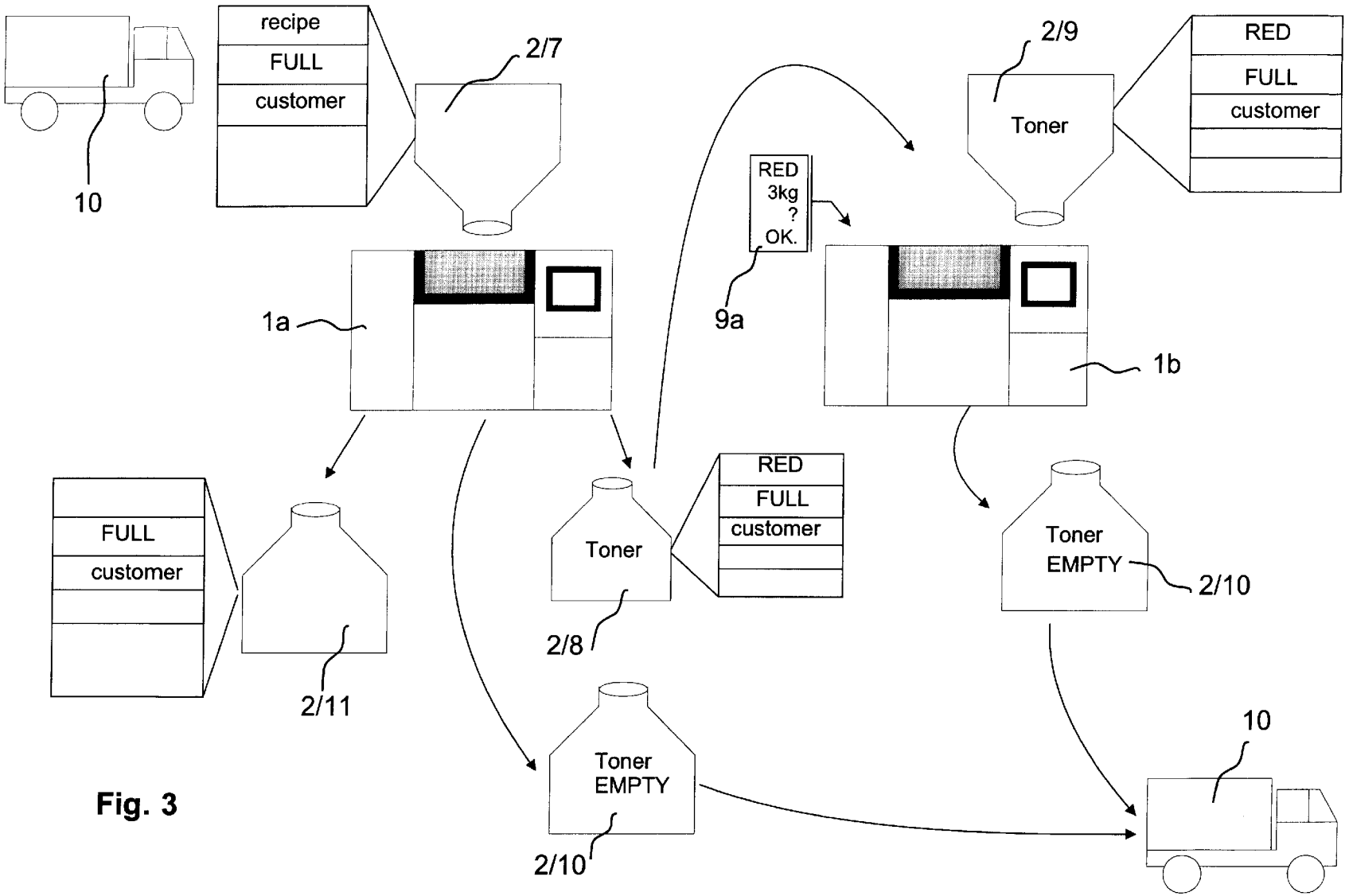
FIG. 3 illustrates a method for repeated employment of a toner supply container.

FIG. 3 shows the use of a toner supply container 2 in a printer center. The filled toner supply containers are thereby delivered with a vehicle 10. The toner supply containers 2 contain particulars in their electronic data store about the toner (recipe) contained therein, about the filling quantity (full) and, optionally, further particulars such as, for example, the customer identification, the filling date of the toner, etc. (See Table 1). The toner supply container 2 is then introduced into the toner station of the printer 1*a*. A read/write unit for reading out the information of the transponder 13 applied on the toner supply container 2 is provided in the toner station. The read/write unit is connected to a microcontroller that interrogates the toner type and checks whether this toner type can be processed. Subsequently, printing parameters (for example, Corotron charges in the region of the electrographic developer station) are set on the basis of the toner type or a toner cross-demand according to WO-A-98/36328 is set. The microcontroller can also process the weight of the toner supply container as well as the position of the toner supply container within the printer 1, insofar as the plurality of printers are provided (for example, given color printers).

The read/write unit is constructed essentially the same as the read/write unit 11 of the filling station 3 (see FIG. 2). It is adapted to the information carrier (transponder) attached to the container 2. In particular, the microcontroller is a component part of the unit control of an electrophotographic developer station and can communicate via a device system bus with other units of the printing device (for example, the control panel, the fixing station or the paper transport unit).

A container that accepts used toner/developer mix can also be provided within the printer 1. This container is likewise provided with a transponder and is identical to the toner supply container 2 in terms of basic structure. However, it is not provided (position 2/11) with a particular about a toner recipe but with a waste disposal identifier, indicating that this is a matter of a waste disposal container. As soon as the container is fall (which, for example, can be identified with a weight measuring system or a filling level sensor), it is provided with an information "full" that is written into the transponder of the waste disposal container 2. Over and above this, it is also possible to redeclare an empty bottle characterized as toner bottle as a bottle characterized as waste disposal bottle within the printing system, for example at a printer via a control panel.

As soon as a toner container is empty (position 2/10), it is removed from the printer and collected by the vehicle 10 for refilling. The same thing occurs with a waste disposal container 2 that must be empty.

Inventively, it is possible to temporarily remove toner containers that are only partially empty from a printer and to reintroduce them later for continued printing. For this purpose, the current filling level information that was measured within the printing device with a suitable sensor is electronically written into the variable memory area of the transponder 13 on the transponder 13 of the toner container 2. Such a container (position 2/8) can later be in turn introduced into the same printer or in some other printer 1*b* (position 2/9). It is processed therein in a way identical to that just described for the printer 1*a*. In data-oriented terms, the printers are preferably networked with one another, so that potential correction data for a specific toner mixture that were identified in a first printer (1*a*) can also be used by the second printer (1*b*). When such a networking is lacking, then these correction data can be transmitted from one printer to the other printer via the data storer (transponder) contained at the toner box. The networking can also be expanded to other components of the described printing system, for example to the filling station (stations), to the central computer, etc.

Both internal data networks (LAN, WAN, company networks) as well as international computer networks (Internet) or telephone lines as well on the basis of a modum can be utilized for the data-oriented network of the various printing system components. The exchange of data, particularly the update of allowable toner types, indications of impending expiration dates of specific toner batches or improved setting parameters for specific toner types can be implemented during the course of remote diagnosis without noteworthy outlay.

The fixed allocation of information at the containers with a transponder comprises essentially electronic and software-oriented mechanisms. These mechanisms can also be supplemented without further ado by mechanical or by other electronic mechanisms. For example, specific toner types (for example, liquid toner) can also be mechanically differently fashioned such that they cannot be mistaken for toner containers in which powdered toner is contained. For this purpose, the mechanically geometrical shape differences can also have a color coding added to them, so that a distinction is also possible for the operating personnel handling the containers.

Figure 4:
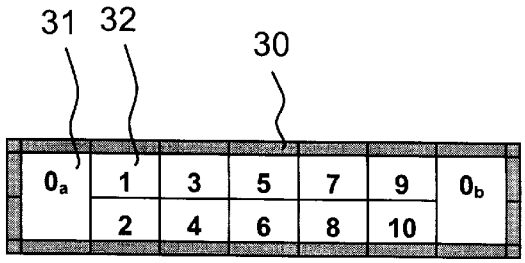
FIG. 4 shows a label with electrically conductive segments.

As an alternative to the above-described transponder, a label 30 is employed in FIG. 4 that is glued on the surface of the supply container 2. The label 30 comprises a plurality of fields ($\mathbf{0}_a$, $\mathbf{0}_b$, 1–10) that can be modified in terms of their conductivity. The conductivity of the individual fields can be selectively eliminated, for example by gluing the fields over with an insulating film, by lacquering the fields with an insulating paint or by punching out the conductive field from the label 30. Two fields ($\mathbf{0}_a$ and $\mathbf{0}_b$) serve the purpose of basic contacting of the label and are redundantly designed.

Figure 5:
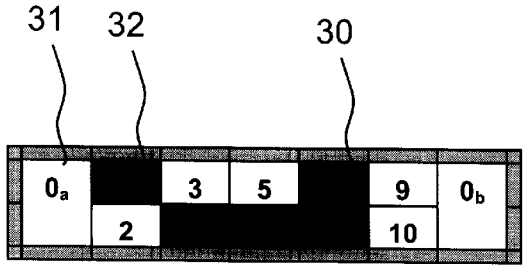
FIG. 5 illustrates an encoded label according to FIG. 4.

FIG. 5 shows a correspondingly binarily encoded label. It represents the value 1,580 ($=2^2+2^3+2^5+2^9+2^{10}$). The fields 31 and 32, for example, are thereby oppositely encoded.

A corresponding read station for reading out such a label code comprises spring pins and contact springs at the printer side that, after the toner container is introduced into the receptacle shaft of the printer provided for that purpose, electrically contact and sense the individual fields of the label. A conductive connection between the two basic contacts $\mathbf{0}_a$ and $\mathbf{0}_b$ indicates that a container is present in the printer. When there is no connection between the contact pins of the read arrangement contacting these fields, then no container is present.

On the basis of a correspondingly large implementation of the individual fields compared to the contact pins, positioning tolerances of the container within the receptacle shaft can be compensated. The contact pins are advantageously designed pointed at their contacting point with the label when the label is located at a horizontal or vertical surface of the container (for example, the container floor) and are designed round when the label is located at a slanting container side.

Figure 6:
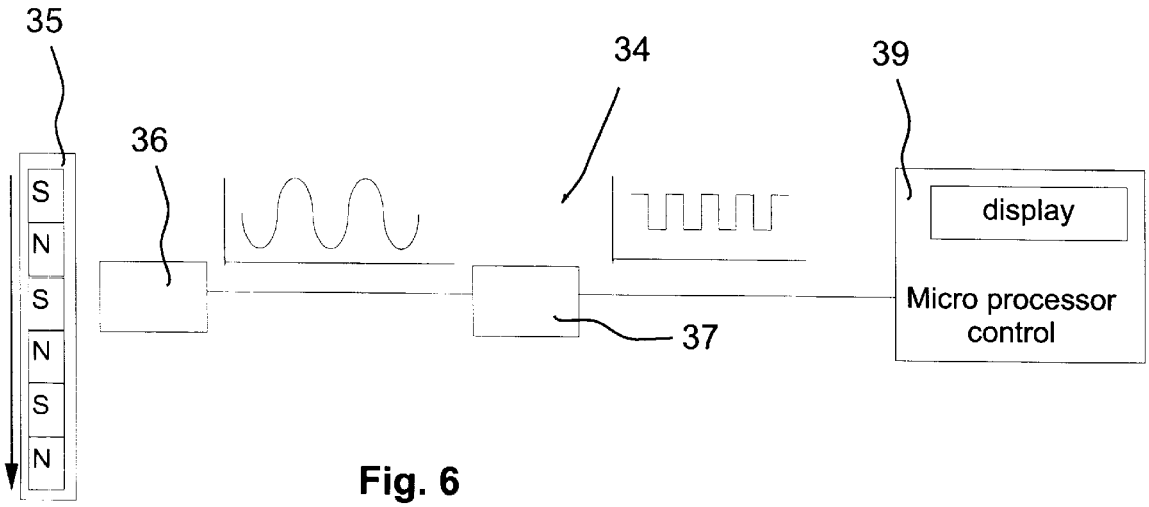
FIG. 6 illustrates a magnetic strip with appertaining evaluation arrangement.

FIG. 6 shows a further, alternative exemplary embodiment of an information carrier that is attached on a supply container. A magnetic plastic band is composed of alternatingly magnetized regions with North Poles N and South Poles S. The magnetic lines are thereby arranged at a uniform spacing from one another. An encoding over, for example, the length of the magnetized band 35 can be achieved with this magnetic line grid. Dependent on the length of the magnetic band and the spacing of the magnetic lines, the number of distinguishable information (toner types, toner color, etc.) is defined. Alternatively thereto, a magnetic label can also be employed that can be rewritten and wherein information are thus variable deposited. Corresponding coding methods are known, for example, from the coding of cash-free forms of payment (money cards). For reading out the information stored in a magnetic strip, a read station 34 can be employed that comprises a magnetic read head 36 as well as a comparator 37 for converting the analog signal generated by the read head into digital signals and that also comprises a control 39 with a microprocessor for counting the digital pulses as well as for the evaluation and control of the read execution. A pre-fabricated band having a fixed magnetic line grid that can be glued on can be employed for coding the container 2. The coding thereby occurs on the basis of the length of the band. The band can be easily glued on and in turn removed. An optical recognition of the informational content is also possible via the band length. Alternatively thereto, a band that is permanently glued on, pressed into the container or sprayed on can also be employed. When filling the container, the magnetic band is then initially erased at the plurality of magnetic lines, i.e. the code is applied with a magnetic write head.

The magnetic read head can be rigidly positioned in a container holder. The magnetically stored information can then be read when the container is inserted into the holder. Following a misread, however, the container must be introduced again. In a somewhat more exemplary embodiment, the sensor is moveable and the magnetic code can thus also be read from the stationary container. Instead of the fixed magnetic line grid, some other coding is also suitable, for example a magnetic grid for coding corresponding to an optical bar code. The optical bar code can, in particular, be presented with a laser ROM card that is erasable and re-writable.

Figure 7:
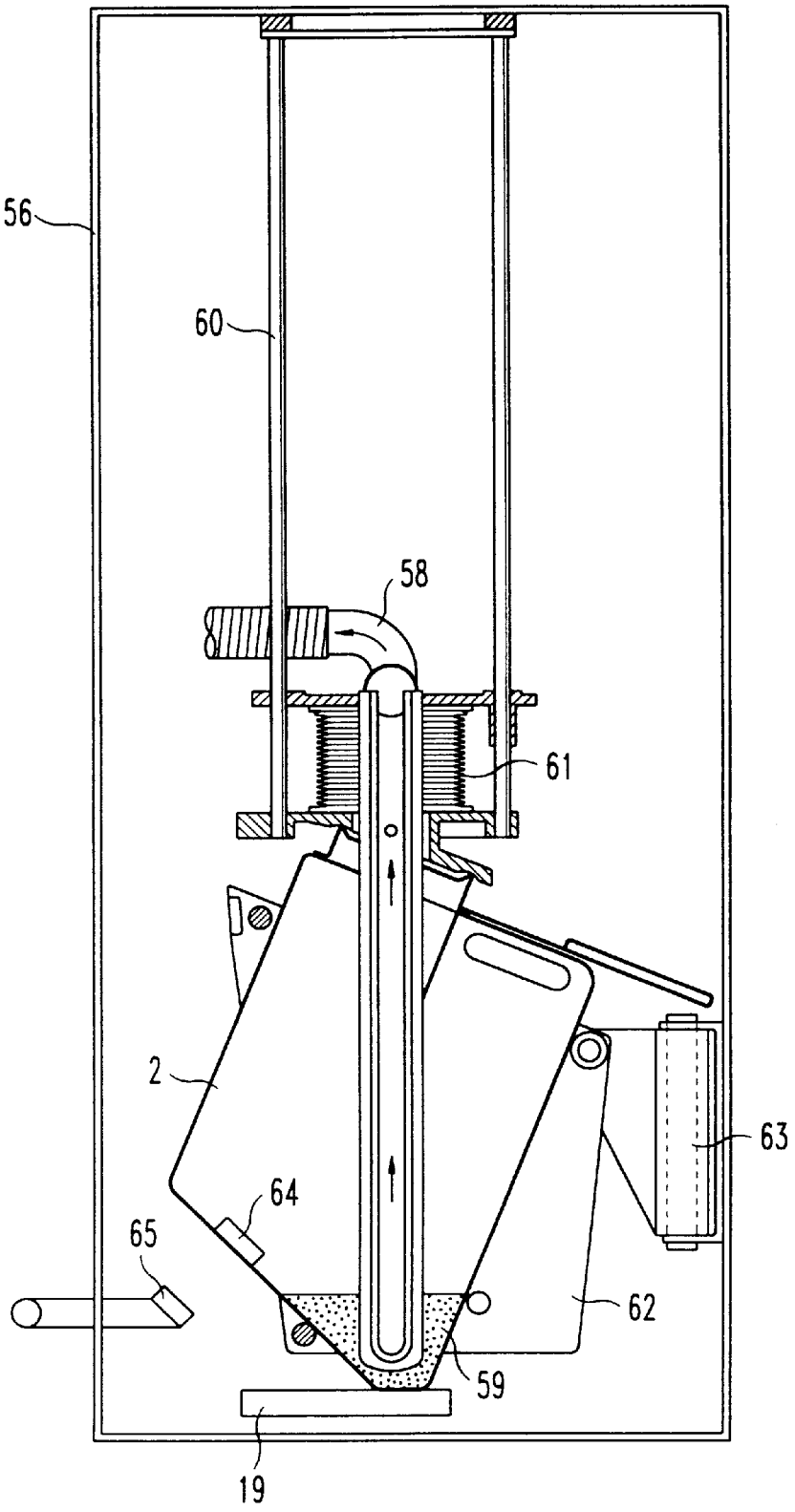
FIG. 7 shows a toner supply container introduced into a developer station.

FIG. 7 shows a toner delivery unit 56 of a developer station that contains a toner supply container 2. The toner 59 located therein is suctioned out of the toner supply container 2 with a suction nozzle 58 and is supplied to further components of the developer station 14. Dependent on the toner filling level in the toner supply container 2, the suction nozzle 58 is displaced along the guide rods 60. An accordion bellows 61 covers the filling opening of the toner supply container and thus protects other components of the developer station 14 against contamination. The toner supply container 2 resides in a receptacle container 62 that is pivotable into the inside of the printer via a hinge 63. Details of this developer station are disclosed in U.S. Pat. No. 5,074,342, whose content is herewith incorporated into the specification by reference.

The toner supply container 2 is provided with a chip card 64 that contains an electronic memory (EEPROM), a drive circuit (IC) as well as an antenna via which a wireless data transfer to a read station 65 can occur. The read station 65 can be optionally secured to the developer station 14 or to the printer housing and is connected to the process control arrangement 40 via a cable connection (for example, CAN bus). It can accomplish both the data exchange with the chip card 64 as well as an energy supply of the chip card 64. Details about such chip cards and read stations are disclosed, for example, in U.S. Pat. No. 5,262,712 whose content is herewith likewise incorporated by reference.

In the illustrated exemplary embodiment, the toner type, the color thereof as well as the filling level of the container are, for example, binarily encoded in the memory (EEPROM) of the toner supply container and are thus stored in machine-readable form. The filling level is continuously updated during the operation of the printer unit in that the amount of toner removed is identified and subtracted from the initial filling level. As a result thereof, it is possible to remove toner supply containers partially emptied from the developer station and to re-employ them later in the same or in some other device. Instead of being determined with a scale, the exact filling level can also be determined in that the amount of toner removed is determined, for example, on the basis of pump cycles of a toner conveying pump. Given the wireless or, respectively, non-contacting data transmission between an inventive read and/or write station and the chip card 64, the energy can be capacitatively or inductively coupled in from the read station.

Figure 8:
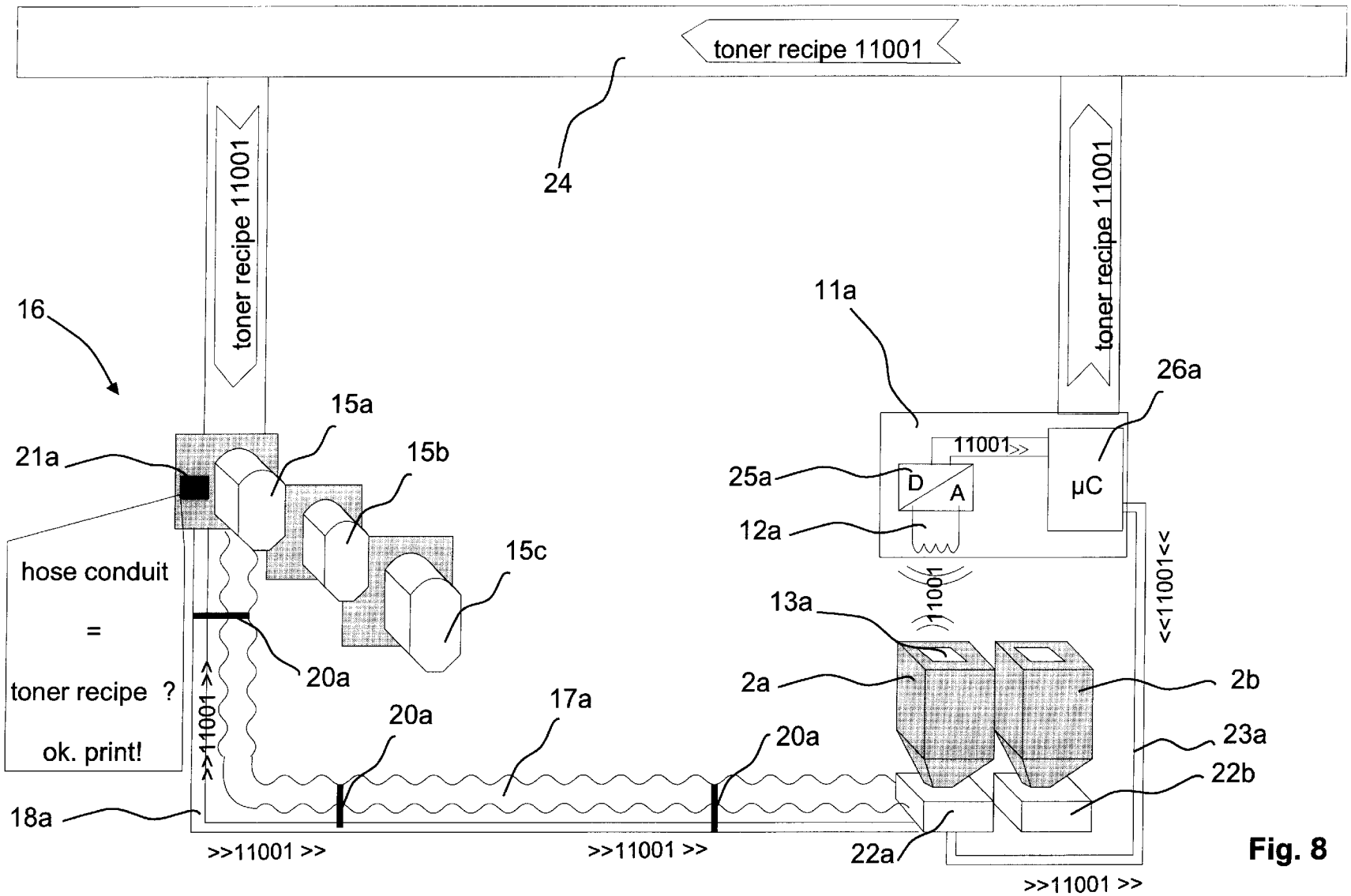
FIG. 8 illustrates component parts of a printer having a plurality of developer stations and a plurality of allocated toner bottles.

FIG. 8 shows a toner conveying system 16 that is located within an electrophotographic printer. It conveys the toner in the containers 2*a*, 2*b* and 2*c* (not shown) in the respectively allocated developer stations 15*a*, 15*b* and 15*c*. For example, red toner is contained in the container 2*a*, this being conveyed via the conveying hose 17*a* to the developer station 15*a* that is configured for printing in a red color and that comprises a corresponding electronic circuit wherein the current color or, respectively, toner recipe of this developer station is contained. In order to assure that the conveying hose 17*a* is connected to the correct developer station 15*a* and to the correct toner container 2*a*, a coding line 18*a* is provided that is connected mechanically rigidly to the conveying hose 17*a* with fastening clamps 20*a*. An electrical connection between the microcontroller 21*a* of the developer station 15*a* and electronic or, respectively, electromagnetic components of a toner conveying unit 22*a* is necessarily produced with the mechanical or, respectively, electromechanical connection of the conveying hose 17*a* to the toner removal components in the region of the toner supply container 2*a* as well as to the developer station 15*a*. The toner conveying unit 22*a* can in turn be connected via a connecting line 23 to the read/write station 11*a* that reads out the transponder 13*a* on the container 2*a*.

Via these connections 23*a*, 22*a*, 18*a*, the controller 21*a* can be informed of the toner recipe (code 11001) located in the container 2*a*. The connection 23*a* serves for the correct allocation between a toner container 2*a* and its toner conveying unit 22*a*. The connection 18*a* serves for the correct allocation between toner conveying unit 22*a*, conveying hose 17*a* and developer station 15*a*. When the connection 23*a* is lacking, then the toner recipe can be transmitted from the read station 11*a* to the controller 21*a* of the developer station via a system bus 24 of the printer instead of being communicated thereto via the lines 23*a* and 18*a*. Therein (or in a higher ranking, central printer control), a check is then carried out to see whether the toner recipe is acceptable and, potentially, the developer station is enabled for printing.

Located within the read station 11*a* are the antenna 12*a*, a drive circuit 25*a* as well as a microprocessor 26*a* with which energy is exchanged with the transponder 13*a* and data are exchanged between microprocessor 26*a* and transponder 13*a* in non-contacting fashion. For checking the correct allocation between toner conveying unit 22*a* and controller 21, a pulse pattern corresponding to the toner recipe, the individual code of the toner supply container or the like is transmitted via the line 18*a*. Alternatively to a pulse pattern transmission, such a check pulse can also be transmitted according to the power line principle via a grounding line. An infeed that is thereby necessary can occur inductively or capacitatively.

In a further version, wherein no data or, respectively, pulse patterns need be transmitted, a sequential procedure occurs. A toner conveying unit (22*a*, 22*b*) is asked by the device controller via the system bus 24 regarding the recipe that is currently located in the allocated toner supply container 2*a*, 2*b*. The corresponding, addressed toner conveying unit 22*a*, 22*b* sets the corresponding hose line 18*a*, 18*b* (not shown) to a defined level that indicates the ongoing interrogation (for example, high). The corresponding developer stations 15*a*, 15*b* must confirm as a reply that the connected hose line indicates the declared level. This procedure is successively repeated for all other developer stations and toner conveyor units. This procedure can also sequence in the reverse direction. What is achieved given this method is that no protocol need be declared for the data transmission on the hose line. Alternatively to the electrical line, a transmission can also occur via light waveguides. In addition to the electronic check, a mechanical and/or color coding of the connecting pieces of the hose and of the corresponding terminals of the developer stations can also ensue, for example round, triangular, quadratic cross-section, etc.

Figure 9A:
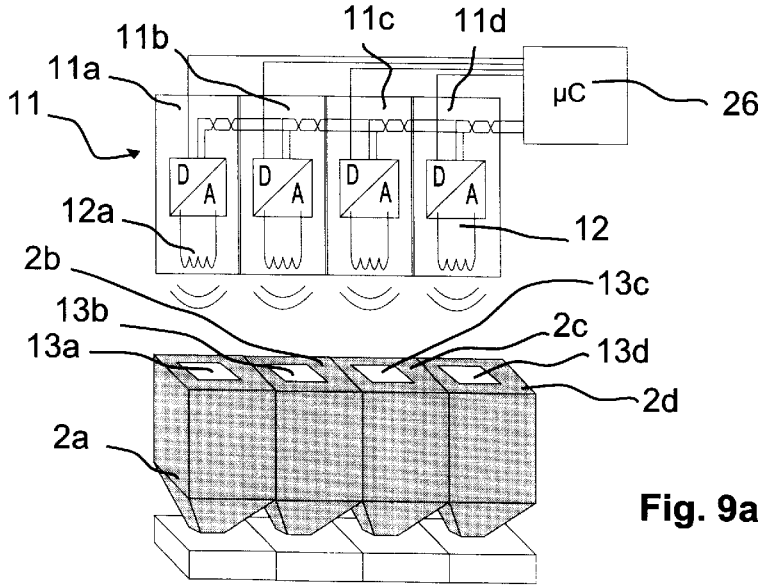
FIGS. 9*a*–9*c* show readout arrangements for a group of toner supply containers with integrated transponders.
Figure 9B:
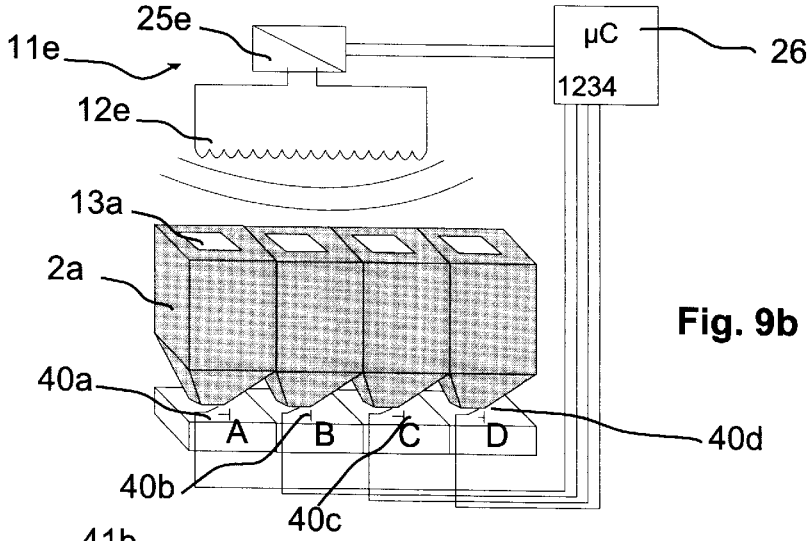
Figure 9C:
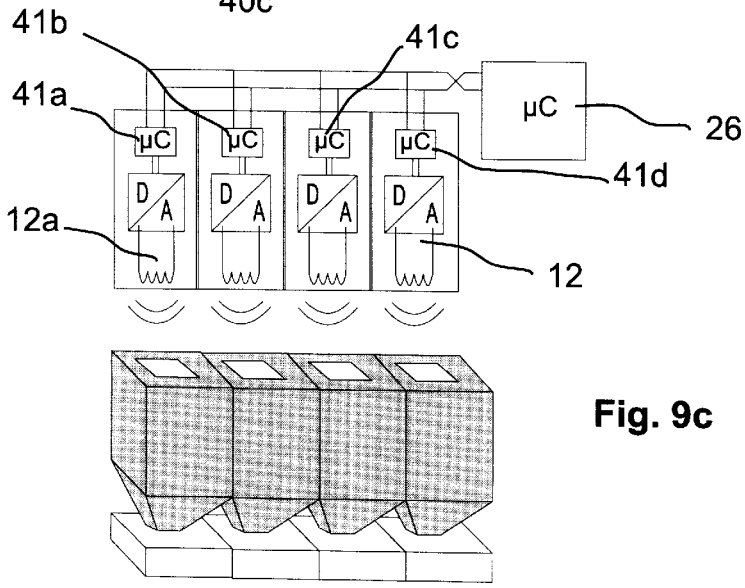

FIGS. 9*a*, 9*b* and 9*c* show various versions of a read and/or write means that monitor a plurality of side-by-side toner supply containers 2*a*, 2*c* and 2*d* with the corresponding transponders 13*a*, 13*b*, 13*c* and 13*d*. It must thereby be assured that the read/write unit allocates the correct transponder to every toner supply container or, respectively, every position. Given the version shown in FIG. 9*a*, a separate transmission and reception interface 11*a*, 11*b*, 11*c* and 11*d* is allocated to each toner supply container or, respectively, each position. Each of these interfaces is composed of an antenna and of an ASIC, which contains a decoder and an encoder. The antenna is respectfully dimensioned such that transponder can be reached only up to a maximum range, particularly up to 5 cm. This maximum range is matched to the spacings of the individual transponders attached to the various toner supply containers. In particular, it is smaller than half the distance between two neighboring transponders.

The interfaces 11*a*, 11*b*, 11*c* and 11*d* are administered by a microcontroller 26 acting as common host. Each of the interfaces 11*a*, 11*b*, 11*c* and 11*d* is thereby selected by a select signal and the readiness to transmit and receive is produced for the respective interface. The hardware identifier of the respective transponder is utilized for the identification thereof.

Given the embodiment illustrated in FIG. 9*b*, a single transmission and reception unit (interface) is designed such that all toner containers with their corresponding transponders are located in the range of a single antenna 12*e*. In order to assure the correct position allocation of the transponder or, respectively, of the toner container connected thereto to the positions A, B, C and D, the toner supply containers 2*a* through 2*d* are only allowed to be replaced successively (serially). Two or more toner containers dare definitely not be removed or, respectively, introduced simultaneously; otherwise, the position allocation in this version is lost. Further, the containers should not be removed from a device that has been turned off. Additional mechanical and electromechanical elements (locks, sensors) that identify a manipulation in the region of the receptacle shafts for the toner supply containers can be provided for the removal or, respectively, the introduction of toner supply containers. As soon as such means are actuated, this is communicated to the microprocessor 26 and the latter initiates the transmission of the current toner amount measured at the appertaining position into the transponder of the toner supply container. For monitoring whether a toner supply container is being introduced or removed, sensors 40*a*, 40*b*, 40*c* and 40*d* are provided that are connected to the common microprocessor 26. They respectively supply a signal where the appertaining toner supply container is introduced or removed.

When one of the toner supply containers 2*a* through 2*d* is then inserted into one of the positions A, B, C or D, then the transmission and reception unit 11*e* checks whether a transponder is within range and identifies it, potentially on the basis of its hardware identifier. The sensor belonging to the corresponding shaft (A, B, C or D) reports to the microcontroller 26 that its shaft has been occupied. With this information and the identifier that has been read out, the toner supply container is unambiguously identifiable and writable. Each further container that is installed is recognized in the same way and the occupation of the shafts or, respectively, positions A through D is identified.

The exemplary embodiment illustrated in FIG. 9*c* essentially identical to the example illustrated in FIG. 9*a*. Differing therefrom, however, all transmission/reception interfaces 11*a* through 11*d* are equipped with their own microcontroller 41*a*, 41*b*, 41*c* and 41*d* that are respectively connected to the common microprocessor 26. In this arrangement, the microprocessor again fulfills a host function.

In all of the embodiments shown in FIGS. 9*a*, 9*b* and 9*c*—as in FIG. 7—, a measuring system is provided for determining the toner respectively removed from the toner supply containers 2*a*, 2*b*, 2*c* or, respectively, 2*d*. The quantity contained is continuously measured and the current toner quantity is stored in the transponders of the corresponding toner supply container by the respective read/write station at predetermined time intervals.

The toner supply containers are integrated in a holder wherein, for example, they are to be hooked. The holder can be provided with one or more closures that must always be opened when a toner supply container must be changed or, removed. The opening of the cover or, respectively, closure triggers an electrical signal that in turn triggers the data transmission on to the transponder. For example, Hall switches can be employed as sensors.

It can also be provided to electromechanically control a corresponding closure at the holder for the toner supply container proceeding from the central device controller. When the corresponding interlock means is opened, the data set in the transponder is then updated, particularly the amount of toner currently contained in the toner supply container is retained. The interlock is enabled only after the data have been updated.

Figures 10A, 10B:
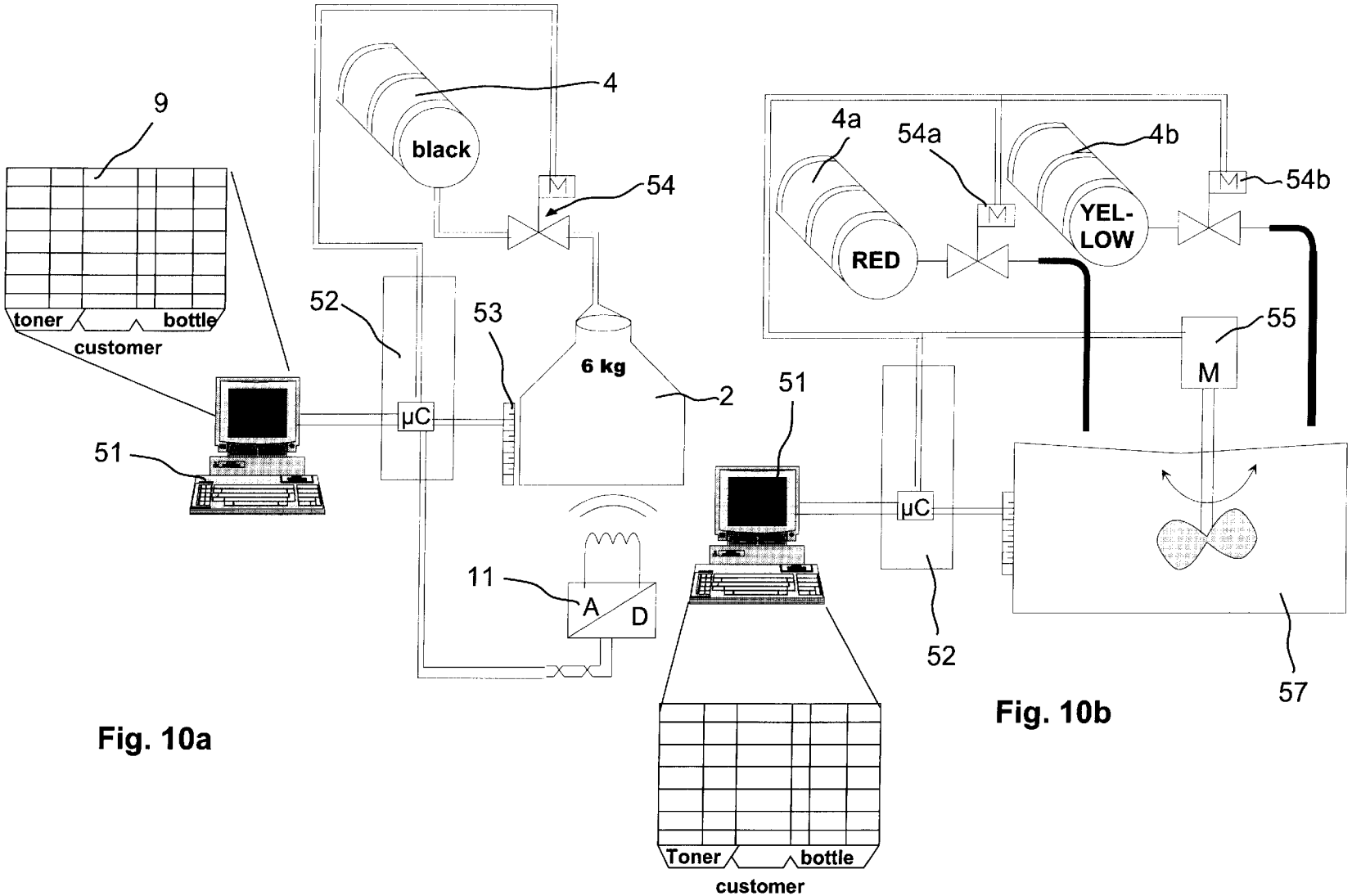
FIGS. 10*a* and 10*b* illustrate various modifications for toner filling systems.

FIGS. 10*a* and 10*b* again show two versions of filling stations. The version shown in FIG. 10*a* is suitable for filling toner of one color. Toner supply containers 2 having a smaller toner content, for example a content of 6 kg, can be filled from the toner storage tank 4 that contains a great quantity of toner, for example 500 kg. The filling procedure is controlled by a filling computer (microprocessor 52) that is connected via a suitable data line or, respectively, via a network connection to a central computer 51 that contains the data bank 9. A testing stand sensor 53 (scale or capacitative height sensor) measures the quantity of toner currently contained in the container 2 and reports the status signal to the microprocessor 52. The latter controls a controllable discharge valve 54. Via a data network, for example via a local area network LAN, via a wide area network WAN or via an Internet connection, the computer 51 can be connected to one or more controllers of printer devices into which the filled toner containers are introduced for printing. A printer or copier system can thus be created that forms a data-technically united but topically distributed unit. The central data bank 9 can thereby be used by all devices connected to the network.

FIG. 10*b* shows a mixing station wherein a corresponding microprocessor 52 controls a plurality of discharge valves 54*a*, 54*b* that controls the variously colored toner supply tanks 4*a* (red), 4*b* (yellow). The respective toner quantities are filled into a common toner mixing container 57 and are uniformly blended with a mixing motor 55 and a mixer screw.

A number of versions have been disclosed for transmitting information in a printing system, particularly into the containers for consumables, and for communicating these to various system components. It is thereby clear that information means that are known and already present can continue to be employed. For example, the containers can continue to comprise labels readable in clear text that contain the respective identifier of the transponder integrated in the container and also contain data about the container content as well as the filling date, expiration date, name of the filler, owner of the container, intended place of employment (customer), etc. In particular, a station configured according to WO 98/27469 is also suitable, the content therewith being herewith introduced into the present disclosure by reference.

In summary, it can be stated again: A method for improving the print quality, particularly for electrographic color printing, is disclosed for a printer or copier system 1. Printing consumables, particularly toner 59, are monitored container-precisely and substance-specific information are employed for controlling the printing process. Expiration dates for the consumables are identified and noted early at the respective printing location. Maculature is thereby avoided. The consumables contained in the container 2 and the quantity of consumables contained therein are thus stored at the container in machine-readable form. An information carrier 13, 30, 35, 38 for non-contacting transmission of data and energy from a data read and/or write station 11 to the container 2 is provided at the container. A transponder 13 is proposed as information carrier, this being provided with an individual identification number (hardware identifier). The identification number can be employed as a component part of codes for device control.

Further, the printer or copier system comprises a recycling concept for consumables containers, particularly for electrographic devices. One and the same container 2 is thereby multiply employed; the current container content can be container-individually acquired by machine at any time. For that purpose, the containers 2 are provided with an information carrier 13, 30, 35, 38 that contains machine-readably encoded information about the current consumable 59 or the consumable 59 most recently contained in the container 2. A non-contacting, electronically writable and readable module is proposed as information carrier, particularly a transponder 13. The data stored in the transponder can be supplied parallel to other system components via a network, for instance a filling station 3, a central computer 51 with a data bank and the printer or copier devices 1.

TABLE 1

"Data and Inter-relationships Between the Locations of The Data Maintenance"

| Data at/in Printer | | Data at the Container | | Data Bank/Filling System |
|---|---|---|---|---|
| Recognition whether valid container (reservation of identifiers), discrimination aid when changing mix, changing the container from one printer to another printer possible | ← | (Fix, laser trimmed) identifier | → | Registration of the container (for individualization of the container) |
| Counter as to how often transponder is written between filling and emptying, carry given printer change | ←→ | Number of how often a transponder was written within a cycle (is updated given "empty" message or, respectively, given removal of the container from the printer | → | Counter of how often transponder was written. Serves for pre-determination and moinitoring of the service life of the container in its intended use as toner supply container and can be individually interrogated with respect to printer or location given stock monitoring of the container pool |
| Waste disposal bit read/write, write only after inquiry at operating panel. The premature conversion of the toner into a waste disposal container in the printer is thus allowed - for exceptions | → | Waste disposal bit (optional) set when a container is introduced into a holder of the printer for receiving used toner/developer mix | ←→ | Conversion of the toner container into waste disposal container when the waste disposal bit is set, registration of the container on the basis of the identifier as waste disposal container, is maintained as waste disposal container in the container pool of the customer, recognitiion of the waste disposal bit upon delivery or, respectively, separation from residual toner |
| Customer number from factory or enter given repurchase | → | Customer number | → | Stock comparison of the toner supply and wast disposal containers in the customer's pool |
| Recipe, comparison to entries in control tables for toner/mix | ← | Recipe number | ← | When filling the container, batches of the primary colors from which the recipe was mixed → derivation of the age of the toner mix |
| Warning about loss of quality given over-aging, etc. | ← | Filing date/expiration date | ← | Filling date, "expiration date" for toner, warning about quality loss given over-aging, etc. |
| Checking the allocation of the toner supply container to the toner conveyor system, unintentional mix-up avoided, is communicated to the developer station so that exchanging developer station and color in another printer possible | ← | ←---------- | ← | Forwarding with diskette or the like |
| Wait/filling level Recognizing when a partially emptied toner supply container is mistakenly filled with different toner: security device stop | → | Wait/filling level | → | Monitoring the toner consumption in toner supply containers, acquiring the contained quantity given waste disposal containers, utilization for statistics and for prognoses |
| Status empty/full | → | Status bit empty/full | → | "Empty" is set only given an emptied container. Given "full", interrogation of the wait additional ensues |
| Correction parameter (service-support given problems with toner) | ← | Correction parameter | ←→ | Correctng error information, producing correction parameters in conjunction with the toner mixture |
| Supplier (service support given problems with toner) | → | Supplier | ←→ | Supplier |

Although various minor changes and modifications might be proposed by those skilled in the art, it will be understood that our wish is to include within the claims of the patent warranted hereon all such changes and modifications as reasonably come within our contribution to the art.

List of Reference Characters

1 Printer
2 Container
2*a*, 2*b*, 2*c* Toner supply container
3 Filling station
4, 4*a*, 4*b*, 4*c* Toner storage tank
5 Cleaning station
6 Testing station
7 Warehouse
8 Waste disposal container
9 Data bank
10 Transport vehicle
11, 11*a*, 11*b*, 11*c*, 11*d* Read/write station
12*a*, 12*b*, 12*c*, 12*d*, 12*e* Antenna
13 Transponder
15, 15*a*, 15*b*, 15*c* Developer station
16 Toner conveying system
17, 17*a*, 17*b*, 17*c* Conveying hose equals toner conveying channel
18, 18*a*, 18*b*, 18*c* Coding line
19 Filling level sensor (scale or capacitative sensor)
20*a* Line post
21*a* Electronics of the developer station
22*a* Toner conveying unit with electronics
23*a* Connecting line
24 System bus
25, 25*a* Drive circuit
26, 26*a* Microprocessor
30 Coding label
31 First coding element
32 Second coding element
34 Magnetic read station
35 Magnetic strip
36 Magnetic read head
37 Comparator
39 Controller
40*a*, 40*b*, 40*c*, 40*d* Position sensor/Hall switch
41, 41*b*, 41*c*, 41*d* Microcontroller
50 Valve
51 Central computer
52 Filling microprocessor
53 Filling level sensor
54 Discharge valve
55 Mixing motor
56 Toner delivery means in a developer station
57 Toner mixing container
58 Suction nozzle
59 Toner
60 Guide rods
61 Accordion bellows
62 Receptacle container
63 Hinge
64 Chip card
65 Read station

What is claimed is:

1. A method for multiple employment of refillable supply containers for a consumable in a printer or copier device, comprising the steps of:

providing an information carrier on the container comprising an erasable electronic memory for erasably storing at least a quantity of consumable present in the container after each filling and refilling and also a non-erasable electronic memory for permanently storing an individual identification number for the container;

allocating the individual identification number to the supply container and storing it in the non-erasable memory;

filling the refillable supply container with a fresh consumable in a filling operation and depositing information about at least specific quantity of the consumable filled in the supply container in electronically readable form in said erasable memory as a result of the filling operation;

before at least partially emptying the supply container in the printer or copier device during a printing or copying process, reading the consumable quantity information from the erasable memory and after at least partially emptying the container writing data indicating a new quantity of consumable left in the container into the erasable memory; and at least partially refilling the at least partially emptied container with a fresh consumable and again depositing information about specific quantity of the fresh consumable present in the container in the erasable memory.

2. The method of claim 1 wherein a type of consumable filled in the container during the filling operation is stored in the erasable memory.

3. The method of claim 1 wherein the non-erasable and erasable electronic memories are part of a transponder which communicates in wireless fashion with the printer or copier device.

4. A method for multiple employment of a refillable supply container for toner in a printer or copier device, comprising the steps of:

providing an information carrier on the container comprising an erasable electronic memory for erasably storing information about a toner present in the container after each filling and refilling and also a non-erasable electronic memory for permanently storing an individual identification number for the container;

allocating the individual identification number to the supply container and storing it in the non-erasable memory;

filling the refillable supply container with fresh toner in a filling operation and depositing information about the toner filled in the supply container in electronically readable form in said erasable memory;

in connection with at least partially emptying the supply container in the printer or copier device during a printing or copying process reading the toner information from the erasable memory and controlling at least one parameter of the printing or copying process based on the information read; and at least partially refilling the at least partially emptied container with fresh toner and again depositing information about the toner present in the container in the erasable memory in connection with the refilling.

5. The method of claim 4 including the step of providing the erasable and non-erasable electronic memories as part of a transponder which communicates in wireless fashion with the printer or copier device.

6. The method of claim 4 including the step of storing both type of toner and quantity of toner in the erasable memory during the filling step.

7. The method according to claim 4 including the step of measuring a quantity of toner present in the container before at least partially emptying the supply container in the printer or copier device and updating a quantity of toner remaining in the container after completion of the at least partial emptying of the supply container in the printer or copier device.

8. A refillable toner supply container for an electrographic high speed printer, comprising:

a container being shaped and designed for refilling with toner;

an information carrier on the container which is readable and writable in wireless fashion; and the information carrier comprising an erasable memory for erasably storing data including a quantity of specific toner present in the container after each refilling operation, and a non-erasable electronic memory for permanently storing a container-individual specific identification number.

9. A refillable consumable supply container for an electrographic high speed printer or copier device, comprising:

a container being shaped and designed for refilling with consumable;

an information carrier on the container which is readable and writeable in wireless fashion; and the information carrier comprising an erasable memory for erasably storing data about the specific consumable present in the container after each refilling operation, and a non-erasable electronic memory for permanently storing a container-individual specific identification number.

10. The consumable supply container of claim 9 wherein the information carrier including the erasable memory and non-erasable memory are associated with a transponder mounted on the container for wireless communication with the printer or copier-device.

* * * * *